United States Patent [19]

Castello

[11] 4,038,840

[45] Aug. 2, 1977

[54] METHOD OF COLLAR FABRICATION

[76] Inventor: Leo J. Castello, 3702 Burnett Lane, Huntingdon Valley, Pa. 19006

[21] Appl. No.: 653,380

[22] Filed: Jan. 29, 1976

Related U.S. Application Data

[63] Continuation of Ser. No. 470,598, May 16, 1974, abandoned.

[51] Int. Cl.[2] ..... A41B 3/00; D04B 9/10; D04B 1/22

[52] U.S. Cl. ..... 66/170; 66/172 R; 2/143

[58] Field of Search ..... 66/170, 171, 172 R, 66/190, 176, 1 R; 2/143, 131, 132

[56] References Cited

U.S. PATENT DOCUMENTS

| | | | |
|---|---|---|---|
| 1,151,652 | 8/1915 | Beers | 66/172 R |
| 1,309,381 | 7/1919 | Van Heusen | 2/131 |
| 1,496,292 | 6/1924 | Brass | 2/143 X |
| 1,584,917 | 5/1926 | Easton | 2/131 X |
| 2,043,715 | 6/1936 | Schuessler | 66/172 R |
| 2,059,123 | 10/1936 | Lawson et al. | 66/1 R |
| 2,150,881 | 3/1939 | King | 2/131 |
| 2,421,357 | 5/1947 | Saftias | 66/170 |
| 2,584,834 | 2/1952 | Bevins et al. | 66/176 |
| 2,696,095 | 12/1954 | Zieve | 66/172 R |
| 2,928,098 | 3/1960 | Haly | 2/131 |
| 3,286,278 | 11/1966 | O'Connor | 2/131 X |
| 3,293,662 | 12/1966 | Seiler | 66/171 X |
| 3,335,582 | 8/1967 | Mishcon | 66/170 |
| 3,812,692 | 5/1974 | Arndt | 66/172 R |

FOREIGN PATENT DOCUMENTS

| | | | |
|---|---|---|---|
| 228,917 | 3/1926 | United Kingdom | 66/171 |

OTHER PUBLICATIONS

Lancashire, The Hosiery Trade Journal, vol. 72, No. 856, Apr., 1965, pp. 135–138.

Lancashire, Knitting Times, vol. 41, No. 30, July 17, 1972, pp. 49–51.

*Primary Examiner*—Mervin Stein

*Assistant Examiner*—A. M. Falik

*Attorney, Agent, or Firm*—Weiser, Stapler & Spivak

[57] ABSTRACT

The method of knitting collars on circular knitting machines including preparing a sketch on graph paper showing the collar configuration stitches, preparing information cards for a circular knitting machine to knit collars in accordance with the instructions contained on the information cards, knitting a tubular fabric including a plurality of circular layers in vertical juxtaposition wherein each layer contains a plurality of individual collars, separating the layers and cutting the knit fabric to sever the collars and then sewing the sides of the collars to produce a plurality of collars suitable for attaching to a shirt or sweater garment.

8 Claims, 8 Drawing Figures

METHOD OF COLLAR FABRICATION

This is a continuation, of application Ser. No. 470,598 filed May 16, 1974 now abandoned.

BACKGROUND OF THE INVENTION

The present invention relates generally to the field of knitted garments, and more particularly, is directed to a novel method of knitting a plurality of collars for use with knitted shirts or sweaters.

It is the present practice to employ flat bed knitting machines to knit collars suitable for use with knitted sweaters, knitted shirts and the like. Fashion pointed collars have conventionally been knitted on flat machines as have collars having oval and straight folding indentation marks thereon. Additionally, Jacquard designs and two and three color collars have all been knitted on flat machines by prior workers in the art. U.S. Pat. No. 3,293,662 is exemplary of one such prior art type of knitted collar construction.

The collars produced on the flat bed machines are quite satisfactory in quality and style, but because of the nature of the operation of the flat machines, the collars are produced one at a time, and accordingly, the production of each collar is deliberate and quite time consuming. When considering the cost of machine operation and the pay received by skilled operators, this time consuming process has resulted in collar fabrication costs which are disproportionately high when compared to the total cost of the sweater or shirt article itself.

SUMMARY OF THE INVENTION

The present invention relates generally to the field of knitting collars, and more particularly, is directed to a novel method of knitting collars by employing circular knitting machines.

The present invention resides in a novel method of fabricating knitted collars on circular knitting machines which results in a far greater production capability at resulting cost savings over that presently possible on flat machines. In utilizing the method of the present invention, circular machines having either Jacquard cards, or pattern wheels or drums or any other known suitable mechanical means of needle selection can be used. For purposes of illustration, a Jacquard type machine with cards, such as a TJI or Links and Links machine will be described. However, it should be kept in mind that the invention is not so limited and that other types of circular knitting machines can be utilized to produce knitted collars in accordance with the present invention.

In producing the knitted collars of the present invention, a sketch is first made on graph paper showing the desired shape of the collar, the design, color, mock fashions, etc. Once the design has been reduced to a suitable drawing, the cards are then punched and set up on the machine. The tubular fabric is designed to produce a plurality of vertically juxtaposed layers, each having a height equal to the height of the collar being produced. A plurality of collars, for example, four are knitted in each layer. Following knitting the tubular fabric with the collars delineated in the layers therein, the layers are separated along predesigned separation lines to thereby provide a plurality of separated layers each containing three, four or even more collars in one layer. The collars are cut along the designed cut marks, the sides are sewn to create finished side edges by using a conventional overedging machine, such as a Merrow sewing machine or other similar, well known, sewing machine.

Narrow strips knit on a border machine, approximately one-half inch wide when folded, can be either sewn, fused, glued, laminated or attached by another similar method on both sides of collar at the cut edges. Borders are "sandwiched" onto both sides of the collar, or, narrow knitted tubular strips can be "butted" together on to the sides of collar.

By employing suitable design techniques which are well known, the knitted collars can be provided with many desirable features on the circular knitting machine, such as a knitted folding crease, knitted sewing marks, mock fashion marks and Jacquard multi-color designs. Previously, such features had to be created independently on one or more slow producing flat machines. All of the features can now be combined on a single circular machine if so desired and knit simultaneously.

It is therefore an object of the invention to provide a novel method of knitting collars by employing circular knitting machines.

It is another object of the present invention to provide a novel method of knitting collars on circular machines which includes steps designed to greatly increase production speed over all previously known collar knitting methods.

It is a further object of the present invention to provide a novel method of knitting collars on circular knitting machines wherein a tubular fabric is knit having a plurality of vertically juxtaposed layers wherein each layer is knit to provide a plurality of collars therein.

It is another object of the present invention to provide a novel method of knitting collars by employing circular knitting machines wherein a plurality of vertically juxtaposed layers are knit in a tubular fabric and wherein separation means are provided intermediate adjacent layers to permit the layers to be readily separated one from the other.

It is another object of the present invention to provide a method of knitting collars with much greater versatility, incorporating more designs, colors, stitch variations, etc. as well as the mock fashion and pointed look than ever before attainable on a single machine.

It is another object of the present invention to provide a novel method of knitting collars employing circular knitting machines wherein features such as a knitted fold crease, knitted sewing marks, knitted mock fashion marks and Jacquard color designs can be simultaneously knitted on a single machine.

It is another object of the present invention to provide a novel method of knitting collars by employing circular knitting machines that is simple in design trouble free when in operation, and capable of greatly increased production speeds.

It is another object to provide a novel method of knitting simulated fashioned pointed collars on circular knitting machines, such as a Links & Links or TJI machine, for outproducing the present method of knitting collars on flat machines and with more versatility of designs and features on a single circular machine than on most flat machines combined.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRITION OF THE PREFERRED EMBODIMENT OF THE INVENTION

Figure 1:
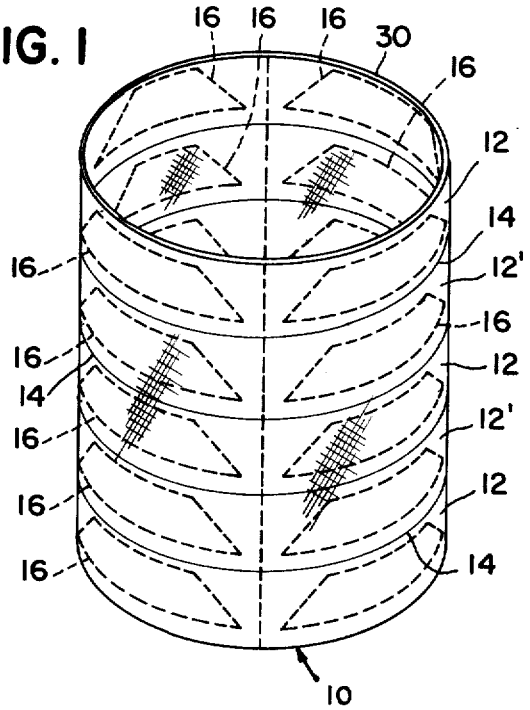
FIG. 1 is a perspective view of a tubular cloth, knit on a circular knitting machine, to produce knitted collars in accordance with the present invention.
Figure 2A:
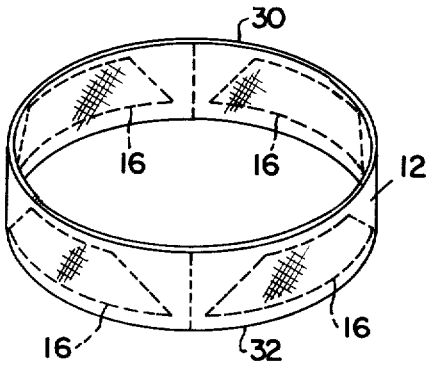
FIG. 2A is a perspective view of one layer of the tubular fabric.
Figure 2:
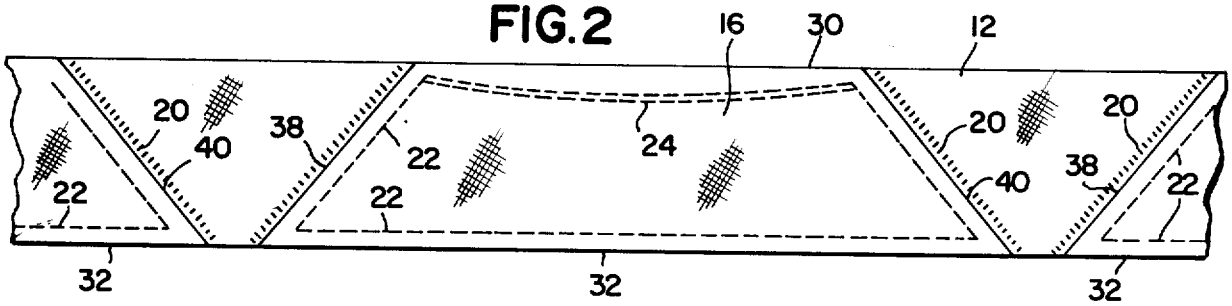
FIG. 2 is a partial elevational view of one layer of the tubular fabric illustrating a knitted collar delineated therein.
Figure 3:
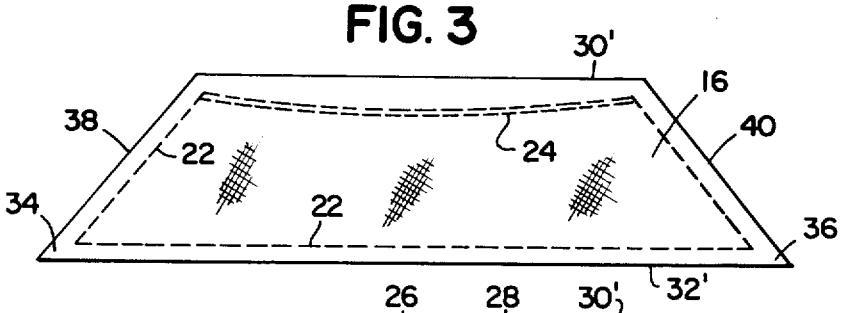
FIG. 3 is an elevational view of a collar after it has been cut from a knitted layer and sewn prior to use.
Figure 4:
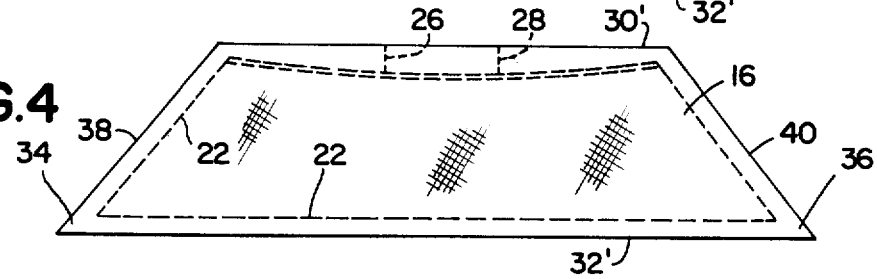
FIG. 4 is an elevational view of a cut collar similar to FIG. 3, and showing the inclusion of knit guide marks for sewing machine operators.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a tubular knitted cloth 10 which can be knitted on a conventional circular knitting machine having either Jacquard cards, or pattern wheels or drums or any other suitable known, mechanical means of needle selection (not illustrated). The tubular cloth 10 is knitted to form a plurality of vertically juxtaposed layers 12, 12' which are defined from each other by draw threads 14. Thus, by pulling a draw thread 14, adjacent layers 12, 12' can be readily separated one from the other. In the illustration shown in FIG. 1, four separate collar constructions 16 are illustrated in each layer 12, 12'. It will be appreciated, however, that more or fewer collar constructions 16 can be provided in each layer 12, 12' as governed by such.variables as the size and style of the collar and the size of the circular knitting machine.

Figure 5:
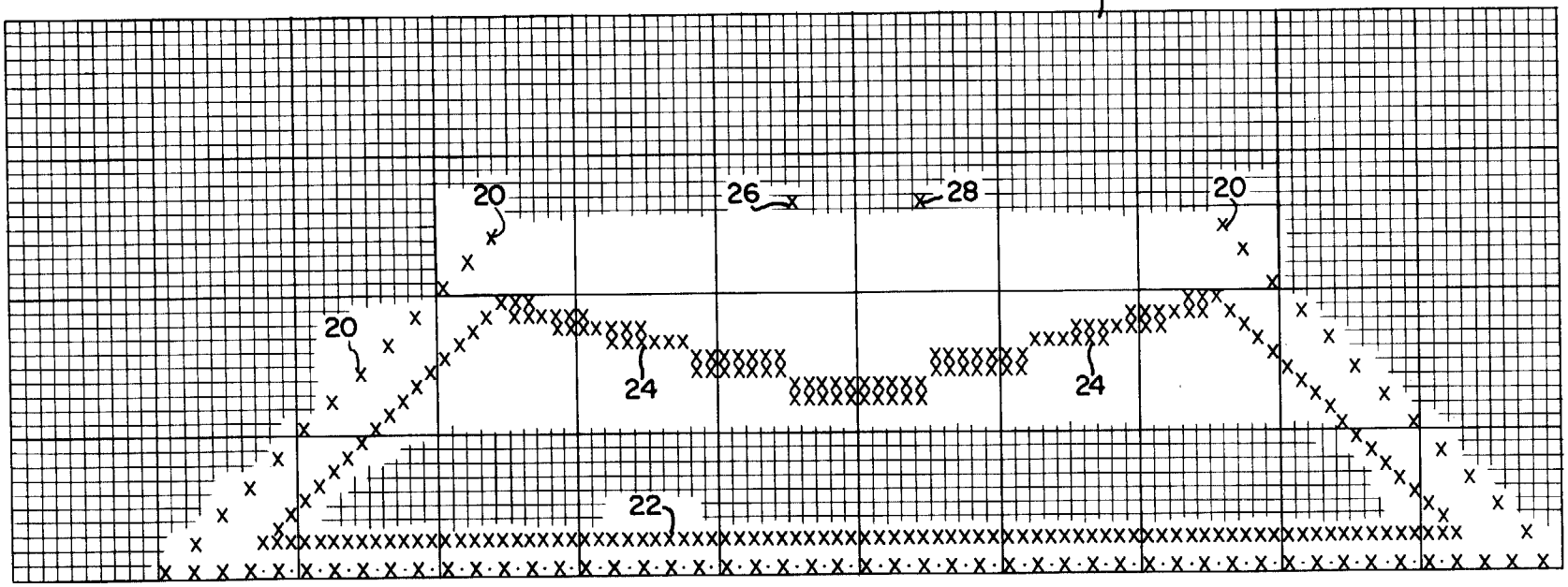
FIG. 5 is a top plan view of a graph showing a collar pattern to be punched on cards prior to knitting.

In accordance with the method of the present invention, as seen in FIG. 5, a graph 18 is first laid out in accordance with practices well known to those skilled in the art to show features such as peripheral knitted cutting guide lines 20, knitted fashion marks 22, knitted neck fold lines 24 and knitted guide marks 26, 28. The guide marks 26, 28 serve as guides to aid sewing machine operators when the collar is being affixed to the remainder of the garment.

After a suitable sketch has been prepared on the graph paper showing the desired collar shape, design, color, mock fashion marks, etc., knitting machine cards (or some equivalent system) are then punched or otherwise prepared in conventional manner and set up on the machine to thereby automatically control the machine stitches to knit the tubular cloth 10 with the layers 12, 12', the separating threads 14 and the collar construction 16 knitted therein. After the tubular cloth 10 has been knit by the machine (not shown), the draw threads 14 are pulled to separate the cloth into a plurality of individual layers 12, 12'. The layers are then cut along the knitted cut guide lines 20 to produce a plurality of individual collars 16, each having cut sides 38, 40. It will be noted that the top and bottom edges 30, 32 of each layer 12, 12' are finished, knitted edges which remain after separation of the layers by pulling the draw threads 14 and can serve as the top and bottom edges respectively, 30', 32', of each individual collar 16 without further sewing or other operations.

Following cutting each collar construction 16 along the knitted cutting guide lines 20, the sides 38, 40 of collar are then sewn on conventional sewing machines to creat finished sides. For this operation, it is preferable to use a known type of over-edging machine, such as a Merrow sewing machine or other similar machines which are suitable for this purpose. The collar is then complete and ready to sew into a garment by employing the knitting guide marks 26, 28 as guides. The collar naturally folds along the knitted neck fold line 24 to provide a superior product in this respect.

By employing the method of the present invention above described, a collar construction 16 can be produced on a single circular knitting machine having an integral knitted fold crease 24, knitted sewing guide marks 26, 28, mock fashion marks 22 and any desired Jacquard color designs (not illustrated) which previously could be produced only independently from one or another by a slow producing flat machine. The fashion marks 22 may be knitted in conventional manner spaced apart in any desired stitch pattern, such as by Jacquard patterns. The fashion marks 22 may be knit continuously about the periphery of the collar. By employing the method of the present invention, all of these features can be combined if so desired and knit simultaneously on one circular knitting machine (not illustrated) such as a TJI or Links & Links machine to thereby far outproduce any existing flat machine. The method of the present invention also eliminates the need for patterns for use when cutting inasmuch as knitting cutting guide lines 20 are knit directly into the tubular knitted cloth 10 during the knitting operation. The only cutting required is along the sides 38, 40 of the collar which have the cutting guide lines 20 already knit directly in the fabric. Mock fashion marks 22 can be knit along the sides 38, 40 and the bottom edge 32' of the collar in any desired design or pattern by employing conventional knitting procedures. The bottom edge 32' of the collar need not be additionally sewn inasmuch as this is a knitted finished edge which remains after pulling the draw thread 14 and so requires no additional operations.

A knitted, indented, circular or straight fold crease mark 24 can be knit directly into the tubular cloth 10 during the knitting operation. I prefer to employ a generally circular neck fold line 24 of jersey stitches as illustrated to thereby create a collar that lays naturally on the back of the neck without "hiking" up or down to thereby enhance the beauty and utility of the collar. The fold 24 remains permanent even after washing or dry cleaning inasmuch as it is knitted directly into the fabric and thus reduces pressing costs in the finished garment. There is no need for a presser to fold and press down the folded part for the knitted fold stitches cause the collar to naturally fold along the knitted neck fold lines 24.

The knitted guide marks 26, 28 form an inportant innovation in that the guide markings are knitted directly into the fabric itself as an aid when sewing the collar onto the other portion of the garment (not illustrated). The guide marks 26, 28 aid the sewing machine operator to properly center the collar on the back of the neck, from sholder seam to shoulder seam (not illustrated) and thus allow both points 34, 36 of the collar to fall evenly and neatly on the front of the garment.

The collar sides 38, 40 can be cut either by shears or any other known cutting device such as a paper cutter or a slicing machine (not shown). The sides 38, 40 can also be cut or burned by using a heating element on a device such as a paper cutter which is attached to the blade of the cutting knife at the edge thereof. In this manner, the edges could be fused or singed prior to sewing to help eliminate frayed edges which sometimes may result from cutting, especially when employing synthetic yarns.

Referring again to FIG. 5, I show a sketch which may be employed in conjunction with an eight-cut L.H. circular machine having 64 levers per automat. Assuming twelve automats, the machine could be programmed to knit three collar constructions 16 per layer 12. In the illustration shown, 768 needles would be employed less approximately 10 needles on each side of the gate an automats one and twelve. A four-card master could be employed to produce three even size collars per strip of sizes L and XL. An eight-card master could be employed to produce two L and XL size collars plus one small or medium size collar. In automat one, two, three, and four, the same cards are duplicated and reversed for automats nine, ten, eleven and twelve. For automats five, six, seven and eight, these would be drawn and punched approximately one inch shorter in neck line width to obtain certain desired size ratios. A twelve card master may be required for this. In accordance with the sketch of FIG. 5, the entire collar construction 16 can be drawn and punched to a desired pattern by employing known procedures, that is, any desired collar point configuration can be designed, more or fewer fashion marks 22 can be provided, more or fewer collar fold marks 24 (knitted as reversed jersey) can be knit, more or fewer stripes, various colors, patterns (not illustrated) can be programmed into the circular knitting machine.

Figure 6:
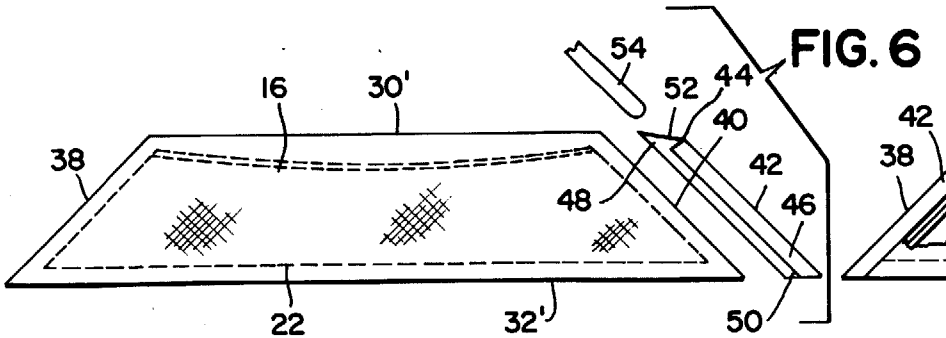
FIG. 6 is an exploded, perspective view showing the method of affixing collar stays.
Figure 7:
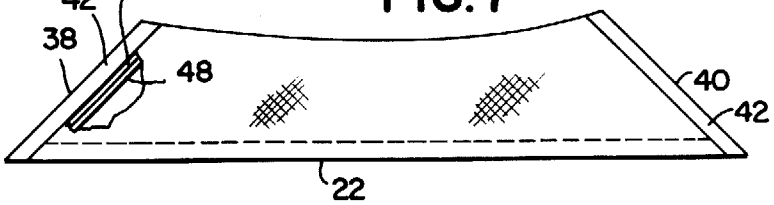
FIG. 7 is a view similar to FIG. 6 showing the assembled stay construction, and partially broken away to expose interior construction details.

Referring now to FIGS. 6 and 7, I show an optional method of finishing the sides 38, 40 of the collar 16 by employing a knitted border strip 42 for this purpose. Preferably, the border strip 42 is knitted on a conventional border knitting machine (not shown) to a width of approximately one inch. Preferably, a longitudinal fold 44 is conventionally provided in the border strip 42 by designing a needle drop to facilitate folding the border strip into front and rear longitudinally extending panels 46, 48. The needle drop can be conventionally provided by eliminating one needle on the center rear bed (not shown) of the knitting machine to automatically create a fold line. The needle drop for defining the longitudinal fold lines 44 preferably is designed offset from the longitudinal axis of the border strip 42 to define a front panel 46 having a width that is approximately one-half the width of the rear panel 48. In this manner, the front panel will be approximately one-third of an inch in width to thereby present a neat appearing side finish to the collar construction 16. The knitted and folded border strip 42 can be conventionally applied to the sides 38, 40 of the collar construction 16 by employing a conventional sewing machine, such as a Singer or similar type machine, or a looping machine, in a manner to cover the frayed edges at the previously cut sides of the collar. The border strip 42 can be conventionally knitted with either a finished bottom edge 50 which would therefore require no bottom strip border sewing, or else, measured cut strips could be employed. If the border strip 42 is cut for this purpose, the bottom edge should be mitered to conform with the point of the collar construction. Then a looping machine or a Singer sewing machine can be employed to affix the border onto the sides 38, 40 of the collar taking care to mark each side of the border for length in order to obtain uniformity on each side of the collar.

When sewing or looping the border strip 42 onto the sides 38, 40, a space can be left open at the top 52 of the rear panel 48 to accommodate a reinforcing stay 54 so that the stay can be inserted between the rear panel 48 and the rear of the collar at the sides 38, 40 in either a removable construction or in a permanently affixed manner. If the stay 54 is to be removable, a slit or buttonhole (not illustrated) can be conventionally sewn into the border strip rear panel 48 prior to affixing to the collar and then the panel can be affixed to the rear of the collar to define a pocket into which the stay 54 can be removably inserted. In this manner, both points 34, 36 of the collar construction 16 can be kept neat, straight and rigid. The collar is then complete and ready to be sewn into a shirt or cardigan type of sweater (not illustrated) knitted or otherwise, or can be attached to any other type of garment. In the event that it is desired to permanently affix the stays 54, the stays 54 would be inserted into the space defined between the rear panel 48 of the border strip 42 and the rear of the collar 16 at the sides 38, 40 and then the panel is permanently stitched in conventional manner to the collar.

By employing the method of the present invention, it will be seen that conventional, presently available circular knitting machines can be employed to far outproduce comparable flat machines to produce collars at far greater speed and far less costs than presently available using conventional collar knitting techniques. A collar constructed in accordance with the present method also has the versatility of providing all of the features as above set forth which can be provided on one circular knitting machine such as a Links and Links circular machine. In accordance with former practice, one type of knitting machine could produce, for example, only a full fashioned pointed collar having no other features. Another type of flat knitting machine may knit only a Jacquard design collar with or without points, or with side striping attachments, but nothing else. Another type of flat knitting machine could be employed for knitting an indented, folding oval collar mark. As above illustrated, a single circular machine can now be employed to incorporate all such features into one machine, thereby producing the capability of knitting many various types of collars on a single circular machine such as a Links and Links machine TJ machine or a TJI machine.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. A method for knitting collars, each of which has a top, a bottom, a right side and a left side, the bottom and the respective right and left sides defining angular right and left collar points therebetween, the steps of A. knitting of tubular cloth of rib type links and links stitches on a circular links and links knitting machine and forming a plurality of juxtaposed tubular strips each having a top and a bottom defining the collar height 1. inserting a draw thread between adjacent tubular strips;

B. knitting a plurality of angularly inclined right and left cutting guide lines in the tubular strips between the top and the bottom to define the right and left sides and angular right and left collar points of a plurality of collars programming the machine to form a plurality of different size collars along a coursewise direction within a tubular strip by varying the distances between said guide lines yet causing adjacent patterns in a walewise direction between the juxtaposed tubular strips to be the same size;

C. knitting a plurality of fold crease lines in a plurality of said tubular strips to define fold lines for the knitted collars, 1. said fold crease lines being knit near the tops of the tubular strips;

D. pulling the draw thread and separating adjacent tubular strips; and

E. severing angularly the tubular strips at the guide lines to form a plurality of individual collars having right and left collar points wherein the top and bottom of the collars are formed by said top and bottom of the tubular strips and the right and left sides of the collars are defined where the tubular strips are angularly severed.

2. The method of claim 1 and the further step of knitting a plurality of angularly inclined right and left mock fashion designs in the strips parallel to the said guide lines.

3. The method of claim 1 wherein the fold crease lines are knitted to extend between respective pairs of right and left mock fashion designs.

4. The method of claim 1 and the further step of knitting at least some of the fold crease lines to be arcuate in configuration.

5. The method of claim 4 and the further step of knitting jersey stitches to define the fold crease lines from the rib type stitch tubular cloth.

6. The method of claim 5 and the step of knitting the jersey stitches of the fold crease lines in superimposed relation over some of the said links and links stitches.

7. The method of claim 1 and the step of knitting guide marks in at least some of the tubular strips near the tops thereof intermediate the collar points, said guide lines being knit to extend in direction that is substantially a right angle to the said tops and to extend from said tops.

8. The knitted collar produced by the method of claim 1.

* * * * *